United States Patent [19]

Guthrie et al.

[11] 4,055,702

[45] Oct. 25, 1977

[54] ADDITIVE-CONTAINING FIBERS

[75] Inventors: Roger T. Guthrie, Westfield; Justin L. Hirshman, East Brunswick; Stanley Littman, Sharon; Edwin L. Sukman, Upper Montclair; Philip H. Ravenscroft, Rowayton, all of N.J.

[73] Assignee: M & T Chemicals Inc., Greenwich, Conn.

[21] Appl. No.: 637,024

[22] Filed: Dec. 2, 1975

Related U.S. Application Data

[60] Division of Ser. No. 521,843, Nov. 7, 1974, Pat. No. 4,001,367, which is a continuation-in-part of Ser. No. 456,130, March 29, 1974, abandoned.

[51] Int. Cl.[2] ..... B29C 17/02; D02G 3/00

[52] U.S. Cl. ..... 428/398; 428/372; 428/921

[58] Field of Search ..... 428/398, 372, 921, 920, 428/375, 376, 364; 252/8.1, 8.6; 264/290 T, 210 F, 154; 260/45.7 P; 106/15 FP

[56] References Cited

U.S. PATENT DOCUMENTS

| | | | |
|---|---|---|---|
| 2,612,679 | 10/1952 | Ladisch | 428/398 X |
| 2,862,284 | 12/1958 | Wiczer | 428/376 |
| 3,015,873 | 1/1962 | Dietzsch et al. | 428/398 |
| 3,069,747 | 12/1962 | Adams | 428/398 |
| 3,400,189 | 9/1968 | Nacke | 428/398 X |
| 3,403,070 | 9/1968 | Lewis | 428/398 X |
| 3,859,151 | 1/1975 | Vincent | 428/921 |
| 3,889,038 | 6/1975 | Wiczer | 427/373 |

*Primary Examiner*—Lorraine T. Kendell
*Attorney, Agent, or Firm*—Robert P. Auber; Kenneth G. Wheeless; Robert Spector

[57] ABSTRACT

Additives can be permanently incorporated into melt spun fibers by cold drawing the fibers under conditions that generate a network of interconnecting microvoids within the fiber. The microvoids are formed in the presence of specified liquid or vapor media which fill the microvoid network. The temperature of the medium is below the effective glass transition temperature of the fibers containing said medium. The additive is either present in said medium or is applied to drawn fibers containing said medium.

10 Claims, 4 Drawing Figures

ADDITIVE-CONTAINING FIBERS

BACKGROUND

This application is a division of U.S. patent application Ser. No. 521,843, filed Nov. 7, 1974, now U.S. Pat. No. 4,001,367, which is, in turn, a continuation-in-part of U.S. patent application Ser. No. 456,130, filed Mar. 29, 1974, now abandoned.

This invention relates to the treatment of melt spun synthetic fibers.

This invention further relates to a method for permanently incorporating additives into already formed melt spun fibers for the purpose of imparting new properties or enhancing one or more inherent properties of said fibers.

It is well known to employ various materials as treating agents for textile fibers to impart new and desirable properties or to enhance those properties which are inherent in the composition or structure of the fiber. Flame retardancy, dyeability and resistance to the accumulation of static electrical charges, soiling and mildew are examples of properties which are often imparted or enhanced by means of relatively low molecular weight organic or inorganic additives that are either present in the bulk polymer prior to the spinning operation or are applied to the surface of the fiber at some step during processing. Modifiers or additives which are applied to the fiber surface are often removed by the abrading of the fiber surface that occurs during normal use and laundering. Under these conditions the properties imparted by the modifier are, at best, only temporary.

Alternatively, a modifier can be added to a solubilized or molten polymer which is subsequently formed into fibers. This requires that the compound be dissolved or uniformly dispersed in the polymer at the desired concentration level and that it not cause coagulation of the polymer. If the additive is for a melt spun or dry spun fiber, it must also withstand elevated temperatures without undergoing significant decomposition or volatilization. This requirement is particularly stringent for polyamides, aromatic polyesters and polypropylene, all of which are usually shaped into fibers at temperatures between 250–300° C. Many organic compounds undergo significant decomposition at or below this temperature range. The criteria of compatability and heat stability considerably limit the class of suitable additives.

German Patent Publication No. 2,255,971 discloses additives derived from the reaction of certain cyclic phosphites with esters of phosphoric, phosphonic, sulfonic or carboxylic acids. These compounds are allegedly sufficiently heat stable that they will not decompose and thereby discolor molten polyesters and polyamides. However, some discoloration admittedly does occur when mixtures of molten polymer and these additives are subjected to localized overheating resulting from an insufficient degree of mixing. Localized overheating can be present in commercial equipment used for the preparation of fibers and films. Although polymer is being continuously extruded, some of the melt, particularly those portions in contact with the walls of the equipment, may travel at a considerably slower rate than others, to the extent that the slower moving portions may remain in contact with heated metal surfaces for up to several hours. This prolonged exposure to elevated temperature is sufficient to cause at least partial decomposition of even the most stable additives.

Many of the decomposition products are colored, and impart this color to the polymer. Since numerous end uses of melt processed polymer require completely colorless products, even the slightest decomposition of the additive must be avoided. In addition, a decomposition of phosphorus-containing esters such as those disclosed in the aforementioned German Patent Publication may form free phosphoric, phosphonic or sulfonic acids. The presence of even small amounts of these acids in the processing equipment is considered detrimental in that the acids initiate degradation of the polymer and corrode exposed parts of the processing equipment.

Prior art techniques for incorporating modifiers within a fiber may not be feasible if the presence of the modifier adversely affects other desirable properties such as tensile strength or dyeability of the fiber.

It has now been found that virtually any additive can be permanently incorporated into melt spun fibers by cold drawing the fibers under conditions that generate a network of interconnecting microvoids within the fibers. The microvoids are formed while the fibers are immersed in a suitable liquid or vapor, which fills the microvoids. The additive to be incorporated is either present in the drawing medium or is applied to drawn fibers while the fibers contain the drawing medium.

SUMMARY OF THE INVENTION

This invention provides a method for permanently incorporating between 0.1 and 25% by weight of an additive into an undrawn or partially drawn melt spun fiber formed from a polyester, polyamide, polypropylene or high density polyethylene, the method consisting essentially of cold drawing said fiber at a draw ratio of between 1.5:1 and the break elongation of the fiber to achieve a localized reduction in the diameter of said fiber. The portion of the fiber wherein the reduction in diameter occurs is maintained in contact with a liquid or vapor containing said additive in solubilized, dispersed or emulsified form and at a concentration of between 0.1 and 100% by weight of said cting vapor is less than 90°;

3. the temperature of said liquid or vaporized liquid medium is below the effective glass transition temperature of a fiber containing said medium.

4. said liquid or vapor is a non-solvent for the fiber

Alternatively, the additive is not present in the medium wherein the fiber is drawn, but is applied to the drawn fiber while the fiber contains the drawing medium, as evidenced by a lower density relative to the same fiber in an undrawn state.

DETAILED DESCRIPTION OF THE DRAWINGS

Figure 1:
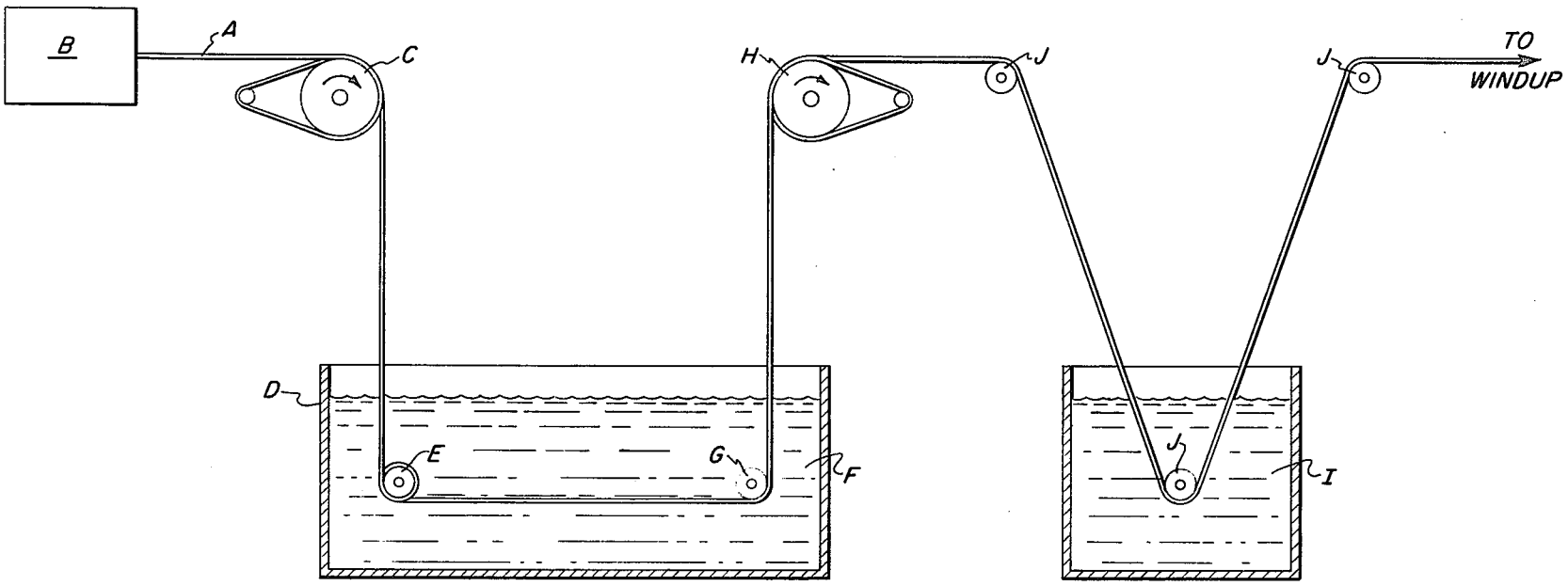
FIG. 1 represents a schematic arrangement of an apparatus useful for carrying out the method of this invention.

FIG. 1 is a schematic diagram of an apparatus suitable for processing textile fibers in accordance with the present method.

Undrawn or partially drawn fiber (A) in the form of monofilament, yarn or tow is continuously withdrawn from a spool or other supply (B) and is passed around driven feed roll (C) which determines the linear speed of the undrawn fiber. The fiber then passes into the draw bath (D) and around a driven roll (E) rotating at the same linear speed as the feed roll (C) to ensure that no drawing occurs before the fiber is immersed in the mixture of additive and liquid diluent (F) which can be maintained at any desired temperatures by a thermostatically controlled heating and/or cooling device (not shown). The driven roll (E) can be replaced by one or more devices which will localize drawing of the fiber within the bath. The fiber passes around a guide (G) and a drawroll (H). The drawroll is driven at a higher linear speed than the feed roll. The ratio between the two speeds, equal to the desired draw ratio, is between 1.5:1 and the breaking elongation of the fiber. Preferably the fiber is passed through a wash bath (I) using suitable guides (J) before proceeding to windup or other collection means.

If an integrated spinning-drawing process is desired the supply (B) is a spinnerette from which fibers are continuously extruded.

In an alternative embodiment of the apparatus, the draw bath (D) contains only a liquid diluent and the wash bath (I) contains the mixture of additive and liquid diluent.

In yet another embodiment, the draw bath, wash bath or both can be closed vessels containing a vaporized additive, diluent, or both. The fiber, yarn or other fiberous material would enter and leave the container through suitable apertures equipped with seals to minimize the escape of vaporized material from the aforementioned closed containers.

DETAILED DESCRIPTION OF THE INVENTION

The present method for incorporating additives into melt spun fibers utilizes the network of interconnecting cavities or microvoids that are formed during cold drawing. The reduction in fiber diameter that occurs during cold drawing is usually localized in a region often referred to as a neck, and is believed to be associated with a rearrangement of the crystallites within the fiber from a random to an oriented configuration. It is in this region that the network of microvoids is most likely to be formed.

It has now been found that if the fiber is immersed in certain liquid or vapor media under specified conditions at the time the micrvoids are formed, a portion of the liquid or vapor will enter the void spaces and become incorporated within the drawn fiber. Liquids and vaporized liquids that swell the fiber between 0 and about 2%, based on the volume of a dry fiber, at the temperature of drawing can be employed as drawing media. The additives can be present in the drawing medium or it can be applied to a drawn fiber wherein the microvoids contain the drawing medium. In the latter alternative, the additive diffuses into the microvoids and displaces a portion of the drawing medium.

Drawing media which swell the undrawn fiber for more than about 2% of the dry volume are not desirable for use in the present method since they may weaken the fiber sufficiently to cause rupturing or disintegration during drawing. The medium is therefore considered a non-solvent for the undrawn fiber.

In addition to being effectively a non-solvent for the undrawn fiber, the drawing medium must wet the surface of the fiber, as defined hereinafter, and be capable of penetrating the network of microvoids that are formed during drawing. To obtain significant penetration of the drawing medium into the fiber, the temperature of the drawing medium must be below the effective glass transition temperature of the fiber in contact with the liquid. It is well known that the presence of a liquid will lower the glass transition temperature of a dry fiber.

The prior art, for example Japanese Patent Publication No. 28,971/73, recognizes that certain flame retardants can be incorporated into polyester fibers if the solubilized flame retardant is applied to the fiber immediately after drawing. The temperature of the solution is preferably between 50° and 200° C., which is well above the effective glass transition temperature of the fiber, and the residence time of the fiber in the solution is between 5 and 600 seconds. The differences between this prior art method and that of the present invention are evident from a comparison of the residence times required to incorporate the desired amount of material into the fiber. Using the present method, a residence time of one second or less is sufficient to incorporate up to 25% of an additive into the fiber. This rapid penetration of additive cannot be achieved at the temperature taught in the aforementioned Japanese Patent Publication. The treatment conditions disclosed in the publication would favor a relatively slow diffusion of additive into the fiber in contrast to the rapid absorption of drawing medium that characterizes the present method.

In accordance with the present method, virtually any liquid or solid additive that can be dissolved, dispersed or emulsified in a suitable liquid or vapor is capable of being permanently incorporated into a fiber of a polyester, polyamide, polypropylene or high density polyethylene. When the drawing medium is a liquid, the additive to be incorporated is present in solubilized form, or as a dispersion or emulsion at concentrations of up to 100%, equivalent to a pure liquid additive without any diluent. Preferably the concentration of additive is between 15 and 40%, based on the weight of the drawing medium. The maximum particle size of the emulsified or dispersed additive is less than two microns.

The additive can also be present as a vapor in a gaseous drawing medium at the same concentration levels specified for the liquid drawing media.

In an alternative of the present method, the fiber is treated with the aforementioned diluent-additive combination or with a vaporized additive subsequent to being drawn. In this instance the fiber is drawn while in contact with a suitable liquid or vapor drawing medium. The fiber is subsequently immersed in a diluent-additive mixture while it still contains some of the drawing medium, as evidenced by a lower density relative to an undrawn fiber of the same polymer. Fibers drawn in accordance with the present method undergo a decrease in density which is believed due to formation of the aforementioned interconnecting network of microvoids. By comparison, fibers drawn at elevated temperature exhibit a higher density relative to the same fiber in an undrawn state. This is believed to result from an increase in crystallinity within the fiber.

Irrespective of whether or not the desired additive is incorporated during or following drawing, the temperature of the drawing medium is below the effective glass transition temperature of a fiber containing the drawing medium. The effective glass transition temperature, usually referred to as Tg, is conveniently determined by differential thermal analysis. Using polyethylene terephthalate as an example, which has a Tg of 69° C, in the dry state, this value is decreased by between 35 and 40° C. when the fiber contains representative liquid diluents, including methanol, diethylene glycol monobutyl ether, water and n-propanol. As disclosed hereinafter, the temperature employed to draw the fiber in the drawing medium for the purpose of determining the Tg should preferably be below ambient temperature to ensure incorporating a significant amount of drawing medium within the fiber.

If the additive is applied following drawing, the temperature of the additive-diluent mixture can be above the effective glass transition temperature of the fiber. The temperature of the medium used to treat a drawn fiber does not significantly affect the amount of additive incorporated into the fiber, as will be demonstrated in the accompanying examples.

THE DRAWING MEDIUM

A. ADDITIVE-CONTAINING DRAWING MEDIA

In accordance with one embodiment of the present method, fibers are drawn in either a liquid diluent or a vapor (such as moist air or a vaporized organic liquid) that contains the desired additive at a concentration of up to 100%, preferably between 15 and 40%, based on the combined weight of additive and diluent.

The residence time of the fibers in the drawing medium is as low as 0.3 second. Residence time has little if any effect on the amount of material incorporated into the fiber during drawing.

Liquids which wet and penetrate within the fiber during drawing usually lower the density of the fiber relative to the density of an undrawn fiber, since most liquids are less dense than the polymer used to form the fiber. The test to determine penetration is conducted by drawing the fiber to obtain an elongation of about 300% while the fiber is immersed in the diluent. To maximize penetration the temperature of the liquid should be below 25° C. The surface of the fiber is dried, following which the density of the fiber is measured using known techniques and compared with the density of the same fiber measured prior to drawing.

Suitable diluents for the present drawing media include water and many organic compounds that are liquid at ambient temperature. The following listing of diluents, while not all inclusive, contains representatives from major classes of organic liquids that are useful for treating melt spun fibers containing aromatic and aliphatic polyesters, polyamides, polypropylene and high density polyethylene.

Mono- and polyfunctional alcohols and ethers derived from polyfunctional alcohols, including methanol, propanol, cyclohexanol, ethylene glycol, propylene glycol, mono- and diethers of glycols, polyfunctional alcohols including trimethylol propane, glycol, pentaerythritol and 1,4-cyclohexanedimethanol.

Amines such as propyl amine, benzyl amine and aniline are useful diluents for polyolefins but may cause degradation of polyesters and polyamines, particularly at the elevated temperatures employed to heat set the fibers.

Liquid carboxylic acids and sulfur-containing compounds may adversely affect polyesters and polyamides, but would be suitable diluents for treating polyolefin fibers.

Carboxylic acid esters would be suitable diluents for drawing and/or incorporating additives into all of the present fibers.

Preferred drawing media for polyesters and polyamides arranged in order of the ability of these media to swell the undrawn fiber at ambient temperature are methanol = ethylene glycol monobutyl ether > diethylene glycol monobutyl ether > water > hexane > heptane.

The broad classes of additives that can be incorporated into melt-spun fibers using the present method include compounds selected from those classes of modifiers conventionally employed for treating textile fibers. Examples of suitable additives include:

Dye receptors such as carboxylic acids, sulfonic acids, and amine salts;

Flame retardants such as halogenated aromatic and aliphatic hydrocarbons, inorganic antimony compounds, and inorganic or organic phosphorus compounds.

Some of the most frequently employed flame retardants include:

Inorganic phosphorus compounds such as ammonium phosphate;

Organic esters of phosphonic and phosphoric acids such as tributyl phosphate, tris (1,2-dibromopropyl) phosphate, tris (2,4,6-tribromophenyl) phosphate, dimethyl methyl phosphonate, (2-chloroethyl) ethylene phosphonate, and diethyl N,N-(2-hydroxyethyl) methylamino phosphonate.

Halogen-containing hydrocarbons, carboxylic acids, glycerides, alcohols and phenols, including brominated castor oil, bis(2,4,6-tribromophenyl) carbonate, decabromodiphenyl oxide, tribromomoneopentyl alcohol, and the various halogenated esters of phthalic acid, such as diethyl tetrabromophthalate.

Conventional anti-static agents such as fatty carboxylic acids, quaternary ammonium compounds, and polyalkylene glycols;

Stabilizers for inhibiting degradation by heat and/or light such as organotin compounds and organic phosphites, e.g. tris-nonylphenyl phosphite;

Mildewcides such as organotin, organoantimony and organomercury compounds, halogenated phenols, organic copper compounds and the copper and zinc salts of the naphthenic acids;

Ultraviolet stabilizers containing conjugated double bonds, particularly benzotriazoles and benzophenones;

Antioxidants such as hindered phenols. A discussion of the various classes of modifiers conventionally used for textile fibers is contained in a text entitled ESSENTIAL FIBER CHEMISTRY by Mary E. Carter (Marcel Dekker, Inc. New York, 1971), the pertinent sections of which are hereby incorporated by reference.

B. ADDITIVE-FREE DRAWING MEDIA

In an alternative embodiment of the present method for incorporating additives into fibers, the medium in which the fiber is drawn does not contain the additive. The additive is applied to a fiber which has been drawn in accordance with the present method. The additive is present in a liquid medium or a vapor that meets all of the criteria set forth for the drawing medium. The liquid or vapor containing the additive need not be identical to the medium in which the fiber is drawn. The concentration of liquid or vaporized additive is preferably between 15 and 40% by weight. Higher concentrations may be employed depending upon the viscosity of the additive-diluent system and the amount of additive to be incorporated into the fiber.

C. THE EFFECT OF TREATMENT CONDITIONS ON AMOUNT OF ADDITIVE INCORPORATED

The amount of additive which can be incorporated into polyester, polyamide, polyethylene or polypropylene fibers using the present method can be varied from less than 1% to 25% or more, based on fiber weight, and is dependent upon a number of parameters, including type and concentration of additive, temperature, and the medium employed to dissolve or disperse the additive.

When the additive is present in the drawing medium, the amount of additive incorporated into the fiber will vary directly with additive concentration, up to a concentration of about 40% by weight, and will vary inversely with temperature. The amount of additive incorporated has been found to be virtually independent of the type of additive.

If the additive is to be incorporated into an already drawn fiber, and the previously stated criteria are all met, the concentration of additive incorporated will be directly proportional to the concentration of additive in the additive-containing medium. The actual contact time between fiber and additive-containing medium may actually be longer than the period during which the fiber is immersed in the medium since the surface of the fiber may entrain an appreciable amount of the mixture as it leaves the additive-containing bath. If this material is not immediately removed by scouring, additional additive will penetrate over a period of up to 3 hours. No significant amount of additional penetration is obtained after three hours of exposure.

The present method for permanently incorporating modifiers is applicable to fibers obtained from polyesters, polyamides, polyester-amides, polypropylene, and high density polyethylene. The polymers exhibit fiber forming properties, in that they can be extruded from a spinerette to form a self-supporting structure. In most instances, this requires that the polymer exhibit an inherent viscosity of between 0.3 and 2.0. The preparation of fiber-forming polymers has been comprehensively discussed in the chemical literature and therefore requires only a brief summary in the present specification.

One class of fiber-forming polymers preferred for use in the present method are polyesters wherein the repeating units of the polymer are joined by ester links, i.e.

$$-\overset{\overset{\displaystyle O}{\|}}{C}O-.$$

These polymers are typically prepared by reacting dicarboxylic acids, esters derived from these acids and monohydric alcohols, or other suitable derivatives of the acids with one or more dihydric alcohols. Depending upon the properties desired in the final fiber the acids can be either aliphatic or aromatic and include succinic, adipic, sebacic, phthalic, isophthalic and terephthalic acids. Suitable diols contain between 2 and 10 carbon atoms and include polymethylene diols and diols containing carbocyclic structures such as 1,4-dimethylolcyclohexane. Poly(ethylene terephthalate) is particularly preferred for use in the present method. Aliphatic polyesters derived from aliphatic alcohols and aliphatic diacids are relatively low melting, however fibers of these polymers are useful in certain applications.

The most commonly employed methods for preparing polyesters are 1) polyesterification of dicarboxylic acids or suitable derivatives thereof with aliphatic diols, 2) the analogous self-polymerization of hydrox carboxylic acids and 3) ring opening reactions of lactones and cyclic esters. The simplest method is a direct esterification whereby a hydroxycarboxylic acid or a mixture of a glycol and a dicarboxylic acid is heated to between 150° and 280° C., at which temperature condensation occurs with liberation of water as a by-product. Since polyesterification is an equilibrium reaction, the molecular weight of the polymer is at least partially dependent upon the completeness with which water is removed from the reaction mixture. Lower molecular weight polymers, which are useful as plasticizers, can be prepared by driving off the by-product water under ambient pressure at the temperature of the reaction. To obtain products of fiber-forming molecular weight it is usually necessary either to carry out the reaction in a boiling organic solvent and remove the water by azeotropic distillation or to employ a precondensation reaction at a relatively moderate temperature followed by a polycondensation which is conducted under reduced pressure and elevated temperature. While high conversions theoretically require equal numbers of moles of reacting groups, it is usually more desirable to employ an excess of the glycol, which may range between 10 and 20 mole percent with respect to the carboxylic acid. The excess glycol replaces glycol removed by distillation and provides hydroxyl-terminated macromolecules which can be further extended by intramolecular alcoholysis.

Direct polyesterification reactions can either be self-catalyzed or catalyzed by various acidic compounds employed in amounts between 0.1 and 2.5%, based on the weight of the reactants. Suitable catalysts include sulfonic acids, antimony pentafluoride, phosphoric acid, titanium alkoxides and dialkyltin oxides. Strongly acidic catalysts are undesirable since they may promote discoloration and hydrolysis of a polymer unless removed from the product.

A preferred method for preparing polyesters involves reaction of an ester of the desired diacid with a relatively low molecular weight monoalcohol, such as dimethyl terephthalate, with a desired glycol, such as ethylene glycol. The initial reaction is believed to involve a transesterification and is carried out at temperatures between about 100° and 250° C. The methanol formed as a by-product is continuously removed from the reaction mixture to ensure that the reaction will go to completion. The resultant bis (hydroxyethyl) terephthalate is heated under reduced pressure at temperatures between 200° and 280° C. Under these conditions the excess ethylene glycol is removed by distillation to yield fiber-forming polymers exhibiting inherent viscosities of 0.5 and higher. A variety of known catalysts can be employed for the transesterification and polycondensation reactions.

The second class of suitable polymers are polyamides derived from the reaction of dicarboxylic acids or suitable derivatives thereof, such as acid chlorides, with diamines. The polymers are characterized by repeating units joined by amide linkages $$(-\overset{\overset{\displaystyle O}{\|}}{C}-\overset{\overset{\displaystyle H}{|}}{N}-).$$

The dicarboxylic acids which can be employed are virtually the same as mentioned in the foregoing discussion of polyesters. The diamines are preferably aliphatic and contain between 2 and 10 carbon atoms.

Polyamides are conveniently prepared by reacting the diacids with the diamines to form amine salts, for example hexamethylene diammonium adipate. Salt formation ensures that the acid and the diamine will be present in the molar ratio of 1:1 required to achieve high conversion to polymer. The amine salt is often separated and washed. Polymerization of the salt to form high molecular weight polymer is readily accomplished by heating a 50 to 60% by weight aqueous solution of the salt to between 260 and 280° C. in an autoclave. Prior to polymerization the autoclave is purged with an inlet gas such as nitrogen to avoid discoloration of the polymer during processing. The pressure increase which occurs during polymerization is relieved by allowing the water which forms as a result of this reaction to distill off. Toward the end of the distillation the contents of the autoclave are placed under reduced pressure.

The condensation polymerizations employed to prepare polyesters and polyamides are relatively slow when compared with the addition polymerizations used to prepare polypropylene and high density polyethylene, the two other classes of suitable polymers. Addition polymerizations proceed rapidly at ambient temperature or below and are usually conducted in the presence of a free radical initiator and a wide variety of catalysts that are well known in the art.

Olefins, which include ethylene, propylene and higher homologs are conveniently polymerized using what has become known as the Ziegler process. The steps involved in this process are catalyst preparation, polymerization at temperatures below 100° C. and atmospheric pressure, polymer purification and finishing. The catalysts are transition metal compounds and are used in combination with alkyl metal compounds as co-catalysts. Titanium trichloride is one of the most widely used transition metal compounds. Isobutyl aluminum hydride and trialkyl aluminum compounds are commonly used as the co-catalyst. Molecular weight can be controlled by 1) chain transfer with catalyst components or with monomer molecules, 2) by thermal termination with metal hydride formation and 3) by the addition of chain transfer agents. The molecular weight of the polymer can be increased by a decrease in the reaction temperature.

Olefins can also be polymerized as emulsions using high pressure and a peroxy compound as the free radical initiator.

Detailed procedures for preparing the foregoing classes of fiber-forming polymers are disclosed and referenced in numerous patents and other literature, including The Encyclopedia of Polymer Science and Technology, edited by H. F. Mark, N. G. Gaylord and N. M. Bikales, published by Interscience Publishers.

Fibers can be prepared from any of the foregoing classes of synthetic organic polymers by extruding the molten polymer through spinerettes containing from one to 100 or more small diameter holes. The solidified fibers are usually drawn or irreversibly lengthened to between 1.5 and 5 or more times their as-extruded length to develop desired levels of tensile strength, modulus and other properties. During drawing the molecules of polymer within the fiber are oriented in a direction parallel to the longitudinal axis of the fiber.

Subsequent processing (such as heat setting, dyeing and wearing) of fibers treated in accordance with the present method removes the diluent and yields a fiber having physical properties comparable to "normally" processed yarns. In addition, treating fibers in accordance with the present method renders them more easily dyeable.

EXAMPLE 1

An undrawn, untwisted, semi-dull yarn of 148 denier, containing 34 polyethylene terephthalate filaments was treated using the apparatus shown schematically in FIG. 1 of the accompanying drawings. The surface speed of the draw roll was 3.5 times that of the feed roll, equivalent to a draw ratio of 3.5:1. The draw bath was 18 inches (45.7 cm.) long and contained a methanol solution of the product obtained by reacting the cyclic phosphite $CH_3CH_2C(CH_2O)_3P$ with dimethyl methylphosphonate in an equimolar ratio. The solution contained 200 g. of reaction product per liter of solution and was maintained at ambient temperature. The residence time of the fiber in the draw bath was 0.5 seconds. The drawn yarn was passed through a container of methanol to remove excess treatment compound and then wound on a take-up spool. A 0.5 g. sample of the treated yarn was removed from the spool and scoured by immersing the sample with constant stirring for 15 minutes in perchloroethylene at a temperature of 60° C., after which the sample was treated in a similar manner for 20 minutes using an aqueous solution containing 0.1% by weight of sodium carbonate and 0.1% of an anionic surfactant (Igepal CO 430). The solution was heated to between 70° and 85° C. The yarn sample was then rinsed with water until the washings were clear, rinsed with methanol and dried for 16 hours in an oven heated to 60° C. Upon analysis the fiber was found to contain 1.59% by weight of phosphorus. A sample of the treated yard was two-plied and and knitted into a number of 4 inch (10.2 cm.)-diameter tubes. The tubes were scoured by immersing them for 30 minutes in an aqueous solution containing 1.0 g. of a conventional scouring agent and 1.0 g. of sodium carbonate per liter of solution. The temperature of the solution was 71° C. The yarn sample was then rinsed with ambient temperature water until the washings were clear. The scoured tubes were then dyed at 100° C. by immersing and agitating them for 1 hour in a 2% solution, based on fabric weight, of Latyl Cerise N, a red dye, in a aqueous solution containing 0.5 and 3.0 g. per liter of a conventional dye carrier and 0.1 g. per liter of a non-ionic surfactant together with sufficient acetic acid to attain a pH of 5.5. A number of the knitted tubes were not dyed but were scoured and laundered 50 times in a domestic washing machine.

The flammability of both the dyed and undyed fabric samples was determined using the Limiting Oxygen Index, which is a measure of the minimum concentration of oxygen in a nitrogen-oxygen mixture that will support combustion. Prior to being tested the knitted tubes were slit open and stitched with fiberglass yarn (Type E12 from Owens-Corning Fiberglass Corp.). Each line of stitching was parallel to the longitudinal axis of the original knitted tube, and contained 7 stitches per inch. The lines of stitching were 0.125 inch (0.318 cm.) apart. The stitched fabrics were placed in a frame, the bottom of which was located 2 inches (5 cm.) above a bed of glass beads through which a mixture of oxygen and nitrogen was admitted. Various mixtures of the two gases were employed to determine the minimum oxygen content that supported combustion of the sample. The Limiting Oxygen Index (L.O.I.) value was calculated using the formula $$\frac{C_{oxygen}}{C_{oxygen}+C_{nitrogen}} \times 100.$$

The concentration (C) of the gases can be expressed in any convenient units, including flow rates in cubic centimeters per minute.

The L.O.I. value of the scoured, undyed sample was 27.0 and the value for the dyed sample was 26.5. The L.O.I. value for the undyed samples which were laundered 50 times was 27.3.

Figure 3:
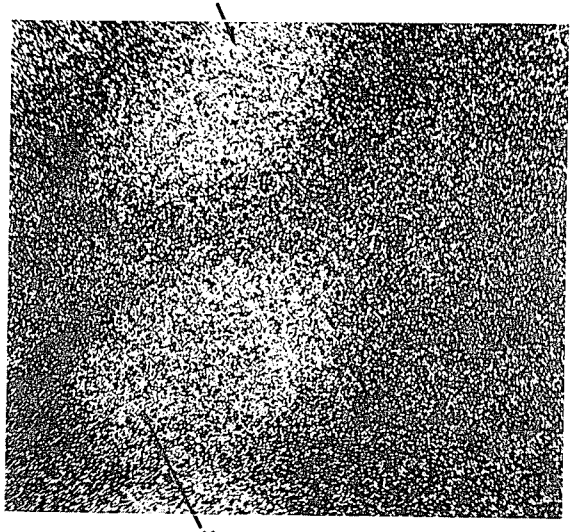
FIG. 3 is a scanning electron photomicrograph which represents the uniform distribution of phosphorus within fibers of the present invention.
Figure 2:
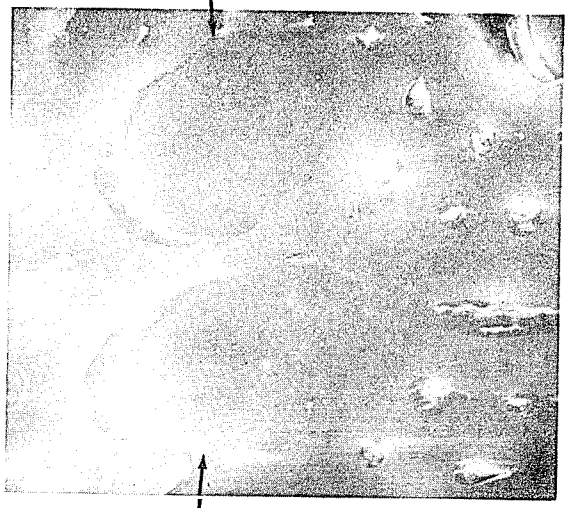
FIG. 2 is a electron photomicrograph of two fiber cross sections at a magnification of 1,000 X, which demonstrates that the present additives do, in fact, penetrate into the interior of the fiber.
Figure 4:
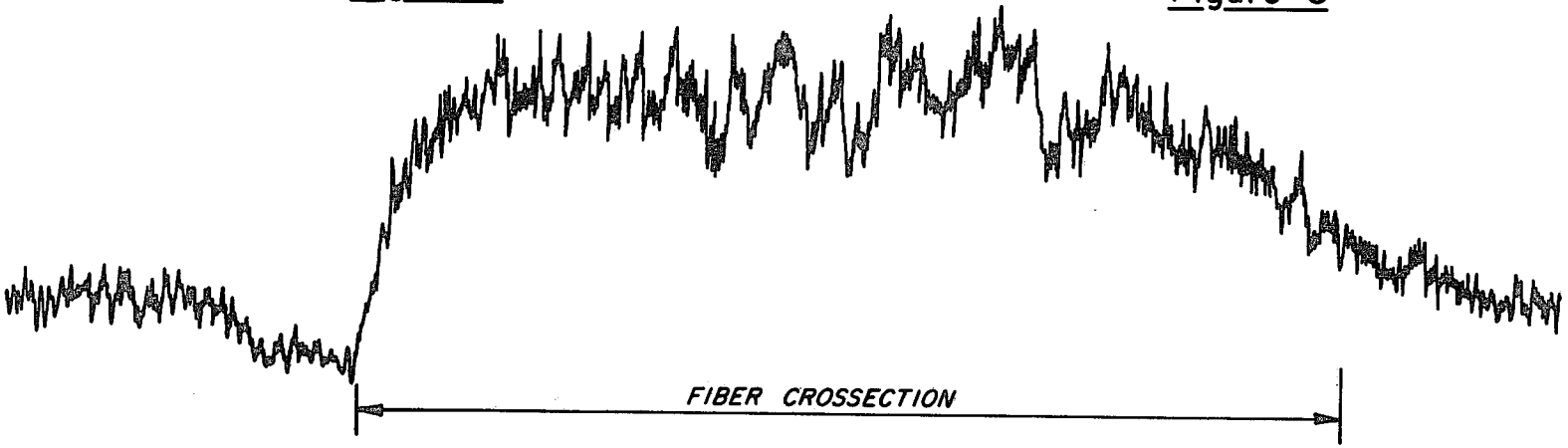
FIG. 4 is a plot of secondary x-ray intensity as a function of distance as the electron beam of the microscope passes across one of the fiber cross sections shown in FIG. 2.

The distribution of phosphorus within an undyed fiber was determined using electron micrographs of a fiber cross-section. FIG. 2 of the accompanying drawings is a scanning electron micrograph showing a cross-sectional view of two adjacent fibers at a magnification of 1000 X. FIG. 3 represents what is commonly referred to as an x-ray mapping of the identical field shown in FIG. 2. The density of the white dots at any point is proportional to the phosphorus content at that point in the field as determined by the intensity of x-rays being emitted at the energy level corresponding to the K line for phosphorus (2.0 Kev) as the sample is scanned with an electron beam. It is evident from FIG. 3 that the areas of maximum phosphorus content correspond to the 2 fiber cross-sections (K) shown in FIG. 2. This indicates that the phosphorus compound employed to treat the fiber has penetrated throughout the entire fiber cross-section. The uniformity of phosphorus distribution is further demonstrated by FIG. 4, which is a plot of the intensity of the x-rays emitted as an electron beam scans the field shown in FIG. 2. The path of the beam is along a line which intersects one of the two fiber cross-sections (K). As in FIG. 3, the area of maximum x-ray emission corresponds to the area of the fiber cross-sections.

Yarn samples were treated with two methanol solutions of the aforementioned cyclic phosphite-dimethyl methylphosphonate reaction product wherein the concentration of reaction product was 150 and 400 g. per liter. After being scoured using perchloroethylene and an aqueous sodium carbonate solution as previously described the yarn treated with the less concentrated solution contained 0.84% by weight of phosphorus. The other sample contained 0.86% by weight of phosphorus.

To demonstrate the effect of the liquid medium in the draw bath on the amount of additive incorporated in the fiber, a polyethylene terephthalate yarn was drawn and scoured as described in the first section of this example, the only difference being that methanol was replaced by diethyl phthalate, a solvent for the phosphorus compound used to treat the yarn. In this instance the yarn contained 0.0% phosphorus after being scoured using perchloroethylene followed by an aqueous sodium carbonate solution as described hereinabove.

Using diethylene glycol, which swells polyethylene terephthalate only slightly, in place of methanol in the foregoing procedure, the phosphorus content of the treated fiber was 0.2% by weight.

EXAMPLE 2

This example demonstrates that a reaction product of trimethylolethane cyclic phosphite and dimethyl methylphosphonate when dissolved in methanol can be permanently incorporated into a fiber.

The reaction product was prepared by heating to the boiling point a mixture containing 1,1,1-trimethylolethane (4 moles), triethyl phosphite (4 moles) and 0.5 cc. of triethylamine under a nitrogen atmosphere. A total of 630 c.c. of ethanol was recovered by distillation from the reaction mixture as the temperature spontaneously increased to 130° C. The temperature of the liquid was then gradually increased to 180° C., during which time another 65 cc. of distillate was collected. The distillation take-off adapter was then replaced with a water-cooled reflux condenser and 4 moles of dimethyl methylphosphonate were added to the reaction mixture. Heating of the mixture to reflux temperature was continued for 6 hours, during which time the temperature of the reaction mixture gradually increased to 230° C. After being cooled to ambient temperature the contents of the reaction vessel were concentrated under a pressure of 0.5 mm. Hg and a temperature of 150° C. The yellow, viscous residue was found to contain 22.4% phosphorus.

A polyethylene terephthalate yarn was treated with a methanol solution containing 265 g. of the foregoing reaction product per liter of solution using the procedure and apparatus described in Example 1. After being rinsed in the methanol bath the yarn was passed around a pin heated to 150° C. prior to being wound up. The yarn was scoured using perchloroethylene followed by an aqueous solution of sodium carbonate as disclosed in Example 1. The yarn contained 1.00% by weight of phosphorus, equivalent to 4.7% by weight of the treating compound.

The distribution of phosphorus within the fiber was investigated using a scanning electron microscope as described in Example 1. The secondary x-ray emission pattern demonstrated that the phosphorus concentration was uniform throughout the fiber cross-section.

EXAMPLE 3

The yarn drawing procedure described in Example 1 was repeated using a methanol solution containing 264 g. of a phosphite-phosphate reaction product per liter of solution. The reaction product was prepared by heating a mixture containing 2.19 moles of trimethylolpropane bicyclic phosphite

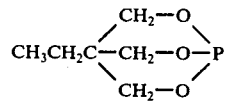

and 6.57 moles of trimethyl phosphate at reflux temperature (200°-5° C.) for 8 hours under a nitrogen atmosphere with agitation. The reaction product was combined with 1 liter of methanol and decolorized using a small amount of activated charcoal. After being filtered to remove the charcoal and other solid materials the liquid was heated at 160° C. under reduced pressure (0.5 mm. Hg) to remove 580 g. of unreacted trimethyl phosphate. The product contained 21.7% by weight of phosphorus.

After being scoured with perchloroethylene and sodium carbonate as described in Example 1, the treated yarn was found to contain 1.15% by weight of phosphorus, which is equivalent to 5.5% by weight of the aforementioned phosphite-phosphate reaction product. The draw ratio for the yarn was 3.5:1, and the treating solution was at ambient temperature.

EXAMPLE 4

This example demonstrates that the reaction product of trimethylolpropane and dimethyl methylphosphonate can be permanently incorporated into a fiber by applying it as a solution in methanol.

The reaction product was prepared by heating to reflux temperature under a nitrogen atmosphere a mixture of 1 mole trimethylolpropane, 6 moles dimethyl methylphosphonate and 1 g. sodium methoxide. Distillation of methanol began when the reaction mixture temperature reached 175° C. The vapor temperature was maintained between 65° and 80° C. during the distillation. Following eight hours of heating the yield of distillate was 95 g. The liquid remaining in the reaction vessel was distilled at 175° C. (liquid temperature) under a pressure of 20 mm. Hg to remove unreacted dimethyl methylphosphonate. A portion of the residue in the distillation vessel was decolorized using activated charcoal and was found to contain 21.5% by weight of phosphorus.

A polyethylene terephthalate yarn was processed as described in Example 3. The drawbath contained a methanol solution exhibiting a concentration of 364 g. per liter of the reaction product described in the preceding paragraph. The draw ratio of the yarn was 3.5:1, as in the preceding examples, and the residence times in the drawbath and methanol rinse bath were each about 0.5 second. The scoured yarn contained 1.15% by weight of phosphorus.

The foregoing procedure was repeated with the exception that the draw bath contained a methanol solution of the reaction product of pentaerythritol and dimethyl methylphosphonate in a molar ratio of 1:2, respectively which was prepared using a procedure similar to that described in the second paragraph of this example. The concentration of the solution in the draw bath was 264 g. of reaction product per liter of solution. The scoured yarn contained 1.05% by weight of phosphorus.

EXAMPLE 5

The polyester yarn described in Example 1 was treated with solutions containing 200 g. of the reaction product described in Example 1 per liter of solution. The solvents employed together with the phosphorus content of the scoured yarn are summarized in the following Table. The process conditions and apparatus employed to draw and treat the yarns are described in Example 1. The drawbath was at ambient temperature unless other specified.

| Solvent | Phosphorus content of yarn (% by weight) |
|---|---|
| Ethylene glycol monoethyl ether | 1.43 |
| Ethylene glycol monobutyl ether | 1.19 |
| Diethylene glycol monobutyl ether (drawbath temperature = 35° C.) | 1.06 |
| n-Propanol (drawbath temperature = 35° C.) | 0.89 |
| n-Propanol | 1.00 |

EXAMPLE 6

A polyethylene terephthalate yarn was processed as described in Example 1 using a draw ratio of 3.5:1. Unless otherwise specified the drawn, treated yarn was scoured using perchloroethylene followed by hot aqueous sodium carbonate, rinsed with methanol and then dried at 65°–70° C., prior to being analyzed for phosphorus.

a. The drawbath contained a methanol solution of the cyclic ester obtained by reacting equimolar amounts of dibromoneopentyl glycol, $(BrCH_2)_2C(CH_2OH)_2$and phenyl phosphoryl dichloride in toluene at 80° C. for 30 minutes, after which the temperature was increased to 95°–100° C. for 12 hours. Nitrogen was then bubbled in to remove the hydrogen chloride generated as a by-product of the reaction. The resultant solution was decolorized using activated charcoal and concentrated under reduced pressure. The solid material which precipitated was recrystallized once from toluene. The recrystallized product was found to contain 8.18% by weight of phosphorous (calculated value = 8.07).

Each liter of solution in the draw bath contained 270 g. of compound. The yarn contained 0.55% by weight of phosphorus.

b. The drawbath contained a methanol solution of tris(diethylphosphinoxymethyl)phosphine oxide (248 g./liter of solution). After drawing and scouring the yarn was found to contain 1.29% by weight of phosphorus. When the methanol was replaced with an equal volume of n-propanol the treated yarn contained 1.04% phosphorus.

Tris(diethylphosphinoxymethyl)phosphine oxide was prepared by heating to reflux temperature a mixture containing 375 g. (1.92 moles) of tris(chloromethyl)-phosphine oxide, 63 g. (0.19 mole) of tris(bromomethyl)phosphine oxide and 2 kg. (12 moles) of triethyl phosphite. When the temperature of the reaction mixture reached 130° C. a liquid began to collect in the distillation receiver and gas evolution was observed. Evolution of gas ceased when the temperature of the reaction mixture increased to 170° C., at which time the molten material in the reaction vessel was poured into a tray and allowed to cool. The resultant solid was pulverized and then stirred together with 2 liters of ether, isolated and dried, yielding 940 g. of a white solid that melted between 168° and 170° C. and exhibited the following analysis:

$$C = 36.7\%;\ H = 7.23\%;\ P = 24.3\%.$$

The calculated values corresponding to the formula $C_9H_{21}O_7P_4$ are:

$$C = 36.0\%;\ H = 7.25\%;\ P = 24.8\%.$$

EXAMPLE 7

A 1368 denier yarn of undrawn polyethylene terephthalate containing 68 filaments was drawn and treated using the apparatus shown in FIG. 1 of the accompanying drawings. The yarn contained 2% by weight of titanium dioxide as a delusterant.

The surface speeds of the feed roll and draw roll were 50 feet (15.2 meters) per second and 200 feet (60.8 meters) per second, respectively. The yarn was treated with a solution containing 50 g. of triphenylphosphine oxide (TPPO) per 100 c.c. of isopropanol or a quantity of pure isopropanol. The liquid was maintained at a temperature of 70° C. After being processed, each yarn sample was wound onto a U-shaped metal frame measuring 2 inches (5.1 cm.) in width and 5 inches (12.7 cm.) in length. The yarn samples were then laundered by placing the frames containing the yarn in hot detergent solution (25 grams of a commercial laundry detergent in 1 quart of water at a temperature of 75°-80° C.). The container holding the detergent was then covered and shaken for 1.5 hours. The test samples were then rinsed in ambient temperature water for 1 hour, after which the washing and rinsing procedures were each repeated two times and the yarn samples allowed to dry in air.

The limiting oxygen index value of the yarn samples was determined by placing the frames containing the yarn in a vertically orientated Pyrex® glass tube into which known mixtures of nitrogen and oxygen were introduced.

The yarn treated with triphenylphosphine oxide solution exhibited a limiting oxygen index value of 28.8 before and after laundering. An undrawn yarn which had not been treated with triphenylphosphine oxide or laundered exhibited a limiting oxygen index of 22.3.

EXAMPLE 8

This example demonstrates that a fiber drawn in accordance with the present method exhibits a significantly lower density relative to an undrawn fiber. The density of undrawn polyethylene terephthalate yarn is 1.34 grams per cc.

The yarn, additive and processing conditions were as described in Example 1, where indicated in the following table. The concentration of the additive in the draw bath was 20 g. per liter of solution, and the same liquid medium was employed in both the draw bath and wash bath. The fiber density was measured following drawing in the liquid medium without any additive and with the additive present.

| LIQUID MEDIUM | DRAW BATH TEMP. (° C.) | % BY WEIGHT OF P IN FIBER | FIBER DENSITY IN (g./cc.) WITHOUT ADDITIVE | WITH ADDITIVE |
|---|---|---|---|---|
| EGMBE | Ambient | 1.05 | 1.02 | 1.16 |
| EGMBE | 50° | 0.16 | >1.39 | 1.29 |
| Water | Ambient | 0.21 | 1.33 | 1.34 |
| Water | 50° | none found | >1.39 | — |
| Methanol | Ambient | 1.15 | 1.03 | 1.19 |
| n-Propanol | Ambient | 1.01 | 1.09 | 1.23 |
| Hexane | Ambient | none found | 1.37 | — |
| Heptane | Ambient | none found | 1.36 | — |
| DGMBE | Ambient | 0.96 | 1.15 | 1.28 |
| Dibutyl Ether | Ambient | none found | >1.39 | — |

EGMBE = Ethylene Glycol Monobutyl Ether
DGMBE = Diethylene Glycol Monobutyl Ether The data in the foregoing table demonstrate that hexane, heptane and dibutyl ether do not reduce fiber density, and are therefore unsuitable diluents for incorporating additives into polyethylene terephthalate during drawing. For those media which reduce fiber density, the amount of additive incorporated is proportional to the relative descrease in density.

EXAMPLE 9

The polyethylene terephthalate yarn described in Example 1 was drawn in ambient air (relative humidity between 60 and 70%), after which it was passed into a bath containing a solution of tris-2,3-dibromopropylphosphate in ethylene glycol monobutyl ether wherein the concentration of phosphate was 200 g. per liter of solution. The residence time of the fiber in the bath was about 0.5 seconds and the bath was at ambient temperature. The fiber was then wound onto a bobbin which was placed in a bath of ethylene glycol monobutyl ether for between 5 and 10 minutes.

After scouring as described in Example 1 the yarn contained 6.33% bromine, equivalent to 9.04% by weight of the phosphate, and exhibited a density of 1.22 g./cc. When the temperature of the phosphate solution was increased to 50° C., keeping all other conditions constant, no phosphate was found in the yarn.

EXAMPLE 10

Using the apparatus and conditions described in Example 1, the draw bath and wash bath each contained ethylene glycol monobutyl ether at ambient temperature. A polyethylene terephthalate yarn was drawn, washed and wound up using this apparatus, after which the yarn, which was still wet with the solvent, was placed in an n-propanol solution containing 200 g. of tris(2,3-dibromopropyl)phosphate per liter of solution. The residence time in the solution was 10 minutes, following which the yarn was scoured as described in Example 1. The yarn contained 23% by weight of the phosphate.

EXAMPLE 11

This example demonstrates the effect of additive concentration in the draw bath on the amount of additive incorporated into a polyethylene terephthalate yarn.

The yarn was drawn, washed and scoured as described in Example 1 using the same cyclic phosphite-phosphonate reaction product. As the concentration of the reaction product in the draw bath was increased from 10 to 30% by weight the phosphorus content in the yarn increased from 1 to 2% by weight. No appreciable increase in phosphorus content was observed when the additive content in the draw bath was increased above 30%. The residence time in the wash bath was about 1/3 of a second, and the time interval between drawing and entering the draw bath was 6 seconds.

EXAMPLE 12

This example demonstrates that additional penetration of additive occurs following drawing of the fiber if the fiber is not immediately scoured.

The yarn, apparatus and drawing conditions were as described in Example 1. The draw bath contained a solution containing the reaction product of Example 1 dissolved in ethylene glycol monobutyl ether at a concentration of 20 g. of additive per liter (1000 cc.) of solution. The time interval between drawing and scouring of the fiber was varied from the several minutes required to remove the freshly drawn fiber from the wind-up spool to 6 hours, with the following results:

| TIME INTERVAL BETWEEN DRAWING AND SCOURING (HOURS) | % ADDITIVE IN FIBER |
|---|---|
| 0 | 5.7 |
| 1 | 6.1 |
| 2 | 6.8 |

EXAMPLE 13

This example demonstrates that the amount of a given additive incorporated into a polyethylene terephthalate fiber is inversely proportional to the temperature of the draw bath.

The yarn, apparatus, additive and processing conditions are described in Example 1. The solvent in the draw bath and wash bath was ethylene glycol monobutyl ether, and the temperature of the wash bath was ambient. The temperature of the draw bath was varied between ambient and 50° C. with the following results:

| DRAW BATH TEMPERATURE (° C.) | % ADDITIVE IN FIBER |
|---|---|
| Ambient | 6.3 |
| 30° | 7.6 |
| 40° | 1.7 |
| 45° | 0.9 |
| 50° | 0.1 |

The foregoing procedure was repeated using diethylene glycol monobutyl ether with the following results:

| DRAW BATH TEMPERATURE (° C.) | % ADDITIVE IN FIBER |
|---|---|
| 40° | 4.7 |
| 45° | 0.8 |
| 50° | >0.1 |

EXAMPLE 14

This example demonstrates that a variety of additives can be permanently incorporated into polyethylene terephthalate fibers using the present method. The yarn and apparatus are as described in Example 1. The draw bath contained a solution of the additive in ethylene glycol monobutyl ether at a concentration of 20 g. per 100 cc. of solution. The wash bath contained the aforementioned glycol ether without any additive. Both baths were maintained at ambient temperature. The yarn was scoured after being drawn and analyzed to determine the percent by weight of additive that had been incorporated into the fiber. The results are summarized in the accompanying table. The additives are represented by letters as follows:

A. A polyvinylphosphonate available as E717G from the Stauffer Chemical Company
B. A chlorinated phosphate available as Phosgard C-22R from The Monsanto Chemical Company
C. A chlorinated phosphonate ester available as ICD-3-378 -from the Mobil Chemical Company
D. A phosphorus-containing polyol available as Vircol 82 from the Mobil Chemical Company
E. A chlorinated phosphonate ester available as C-7 from the Mobil Chemical Company
F. Dibromobutanediol
G. Tribromoneopentyl alcohol

| ADDITIVE | % BY WEIGHT OF ADDITIVE IN YARN |
|---|---|
| A | 8 |
| B | 10 |
| C | 10 |
| D | 10 |
| E | 12 |
| F | 7 |
| G | 8.5 |

EXAMPLE 15

A carbon-filled polypropylene yarn (970 denier, 64 filaments) was proposed using the apparatus and draw ratio described in Example 1. The additive was tris(2,3-dibromopropyl)phosphate (T-23P) as a solution in ethylene glycol monobutyl ether (EGMBE) at a concentration of 20 g. of additive per 100 cc. of solution.

The draw bath contained only EGMBE and the wash bath contained the solubilized additive. The temperature of each bath, the density of the treated fiber following scouring and the concentrations of bromine and phosphorus in the fiber are summarized in the following table. The temperature of the baths were ambient unless otherwise specified.

| BATH TEMPERATURE | | FIBER DENSITY (g./cc.) | % Br. | % ADDITIVE |
|---|---|---|---|---|
| ambient | (draw bath) | 0.86 | 3.45 | 4.9 |
| 30 | " | 0.86 | 3.48 | 5.0 |
| 35 | " | 0.88 | 2.64 | 3.8 |
| 45 | " | 0.85 | 3.31 | 4.7 |
| 50 | " | 0.89 | 2.92 | 4.2 |
| ambient | (wash bath) | 0.85 | 3.35 | 4.8 |
| 30 | " | 0.86 | 3.33 | 4.8 |
| 35 | " | 0.86 | 3.94 | 5.6 |
| 45 | " | 0.86 | 4.15 | 5.9 |
| 50 | " | 0.87 | 3.88 | 5.5 |

The foregoing data indicates that while the present method is suitable for permanently incorporating additives into polypropylene fibers, the relationship between amount of additive and bath temperature is not so critical as for polyesters.

EXAMPLE 16

A polyethylene terephthalate yarn was drawn and scoured as described in Example 1. The draw ratio was 3:1 and the draw bath contained a solution of triphenyl antimony dissolved in the monobutyl ether of ethylene glycol at a concentration of 25 g. of triphenylantimony per 100 cc. of solution. The wash bath contained the solvent alone, and both the draw bath and wash bath were at ambient temperature.

The yarn was found to contain 3.82% by weight of antimony, equivalent to about 11% by weight of the antimony compound.

What is claimed is:

1. A melt spun, cold drawn fiber of a synthetic organic polymer selected from the group consisting of polyesters, polyamides, polypropylene and high density polyethylene, said fiber containing from 0.1 to 25%, based on the weight of said fiber, of an additive which at least partially occupies a network of interconnecting microvoids extending along the entire length and throughout the cross section of said fiber, said additive being selected from the group consisting of dye receptors, flame retardants, anti-static agents, stabilizers, mildewcides and antioxidants.

2. A fiber according to claim 1 wherein said synthetic organic polymer is a polyester or polypropylene.

3. A fiber according to claim 2 wherein said polyester is polyethylene terephthalate.

4. A fiber according to claim 3 wherein said additive imparts flame retardancy to the fiber.

5. A fiber according to claim 4 wherein said additive is selected from the group consisting of a. compounds of the general formula

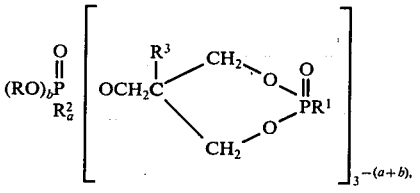

b. reaction products of a polyhydric alcohol of the formula $HOCH_2CH_2OH$ or $R^4(CH_2OH)_c$ with a phosphorus-containing ester exhibiting a generic formula selected from the group consisting of

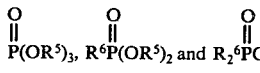

wherein the number of moles of polyhydric alcohol per mole of phosphorus-containing ester is between 1 and the total number of $OR^5$ radicals, c. triaryl phosphine oxides of the general formula

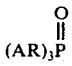

wherein Ar represents an aryl or an alkaryl hydrocarbon radical d. compounds of the general formula

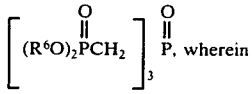

wherein $R^1$ and $R^5$ each represent an alkyl radical containing between 1 and 18 carbon atoms, $R^3$ represents a methyl, ethyl, propyl or hydroxymethyl radical, $R^4$ represents an acyclic hydrocarbon radical containing between 1 and 4 carbon atoms and exhibiting a valence of c, $R^2$ and $R^6$ each represent an alkyl radical containing between 1 and 20 carbon atoms, a cycloalkyl, aryl, alkaryl or aralkyl radical, *a* represents the integer 0 or 1, *b* is the integer 0, 1 or 2 and *c* is the integer 2, 3 or 4, and e. bromine-containing triesters of phosphoric acid.

6. A fiber according to claim 1 wherein said additive is a solid.

7. A fiber according to claim 1 wherein said additive is a liquid.

8. A fiber according to claim 1 wherein said additive is an antistatic agent.

9. A fiber according to claim 1 wherein said additive is a mildewcide.

10. A fiber according to claim 1 wherein said additive is present as a solution in a solvent selected from the group consisting of water, monofunctional and polyfunctional alcohols, ethers derived from polyfunctional alcohols, amines, liquid carboxylic acids, liquid carboxylic acid esters and sulfur-containing compounds.

* * * * *

UNITED STATES PATENT OFFICE
CERTIFICATE OF CORRECTION

Patent No. 4,055,702 Dated October 25, 1977

Inventor(s) ROGER T. GUTHRIE ET AL.

It is certified that error appears in the above-identified patent and that said Letters Patent are hereby corrected as shown below:

Column 2, line 42 - Delete "cting" and substitute therefor --liquid or vapor, wherein 1. the maximum particle size of the additive is less than 2 microns;
2. the contact angle between the polymer which constitutes said fiber, the liquid or condensed vapor and air or other contacting--.

Column 3, line 58 - Delete "micrvoids" and substitute therefor --microvoids--.

Signed and Sealed this

Thirtieth Day of May 1978

[SEAL]

Attest:

RUTH C. MASON
Attesting Officer

LUTRELLE F. PARKER
Acting Commissioner of Patents and Trademarks